US011489264B2

(12) United States Patent
Rashid et al.

(10) Patent No.: US 11,489,264 B2
(45) Date of Patent: Nov. 1, 2022

(54) FOLDED ANTENNA

(71) Applicant: Telefonaktiebolaget LM Ericsson (publ), Stockholm (SE)

(72) Inventors: Hawal Rashid, Hisings Backa (SE); Ingolf Larsson, Mölndal (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

(21) Appl. No.: 16/976,251

(22) PCT Filed: Mar. 21, 2018

(86) PCT No.: PCT/SE2018/050294

§ 371 (c)(1),
(2) Date: Aug. 27, 2020

(87) PCT Pub. No.: WO2019/182492

PCT Pub. Date: Sep. 26, 2019

(65) Prior Publication Data

US 2021/0021046 A1 Jan. 21, 2021

(51) Int. Cl.
*H01Q 13/08* (2006.01)
*H01Q 1/36* (2006.01)
(Continued)

(52) U.S. Cl.
CPC ..... *H01Q 13/085* (2013.01); *H01Q 1/36* (2013.01); *H01Q 1/38* (2013.01); *H01Q 21/29* (2013.01); *H01Q 25/001* (2013.01)

(58) Field of Classification Search
CPC ..... H01Q 11/04; H01Q 11/086; H01Q 13/16; H01Q 5/48; H01Q 13/085; H01Q 1/36; H01Q 21/29; H01Q 25/001
See application file for complete search history.

(56) References Cited

U.S. PATENT DOCUMENTS 6,424,313 B1 7/2002 Navarro et al.
6,750,821 B2 * 6/2004 Fang ..... H01Q 1/242 343/700 MS (Continued)

FOREIGN PATENT DOCUMENTS

CN 203434271 U * 2/2014
CN 105576353 A 5/2016

(Continued)

*Primary Examiner* — Vibol Tan
(74) *Attorney, Agent, or Firm* — Coats & Bennett, PLLC

(57) ABSTRACT

Antenna unit (16) comprising a flexible or bendable printed circuit board, PCB, (17), being divided into a number of sections (11), each section (11) being delimitated from another section (11) by a straight folding line (23). At least one section (11) accommodates an antenna element (10), and at least another adjacent section (11) is either accommodating an antenna element (10) having a terminal area (15) or is a terminal area (15). The antenna element is coupling to the terminal area (15) for feeding the antenna element (10), the adjacent sections (11) of the PCB being folded along the corresponding delimitating folding line (23) and being kept in or keeping a fixed position, such that the adjacent sections (11) are arranged at respective angles while each section (11) is maintaining a substantially plane configuration.

20 Claims, 10 Drawing Sheets

(51) Int. Cl.

| | |
|---|---|
| ***H01Q 21/29*** | (2006.01) |
| ***H01Q 25/00*** | (2006.01) |
| ***H01Q 1/38*** | (2006.01) |

(56) References Cited

U.S. PATENT DOCUMENTS

| | | | | |
|---|---|---|---|---|
| 7,345,632 | B2 * | 3/2008 | Smith | H01Q 1/246 342/374 |
| 8,253,638 | B2 * | 8/2012 | Siemsen | H01Q 9/285 343/730 |
| 8,564,492 | B2 * | 10/2013 | Mast | H01Q 21/064 343/786 |
| 2004/0155819 | A1 | 8/2004 | Martin et al. | |
| 2005/0264448 | A1 | 12/2005 | Cox et al. | |
| 2009/0009421 | A1 | 1/2009 | Suprunov et al. | |
| 2011/0291900 | A1 | 12/2011 | Siemsen et al. | |
| 2017/0229763 | A1 * | 8/2017 | Barak | H01Q 1/38 |

FOREIGN PATENT DOCUMENTS

| | | | | |
|---|---|---|---|---|
| EP | 2779307 | A1 | | 9/2014 |
| EP | 3240105 | A1 | | 11/2017 |
| JP | 2006007505 | A | | 1/2006 |
| JP | 2015015374 | A | * | 1/2015 |
| WO | 2012118636 | A2 | | 9/2012 |

* cited by examiner

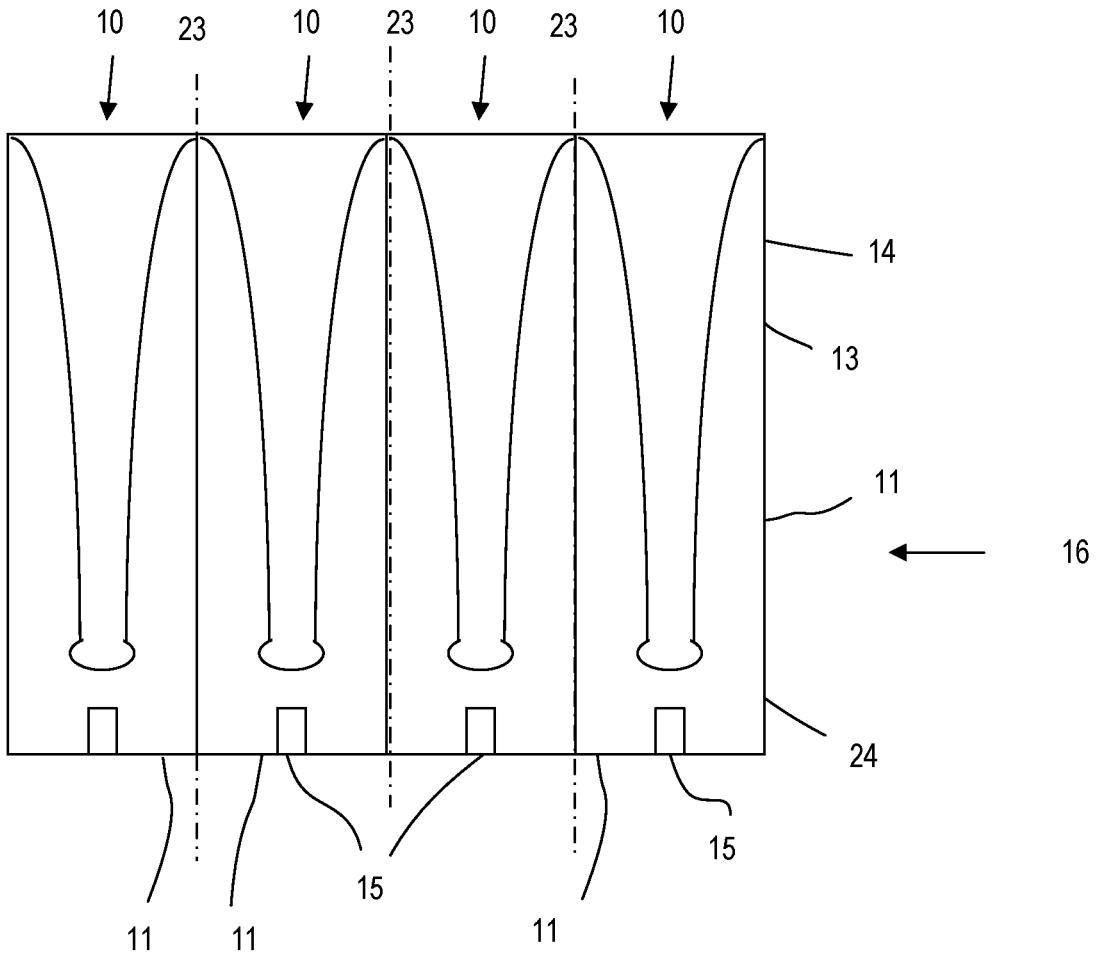
FIG. 9
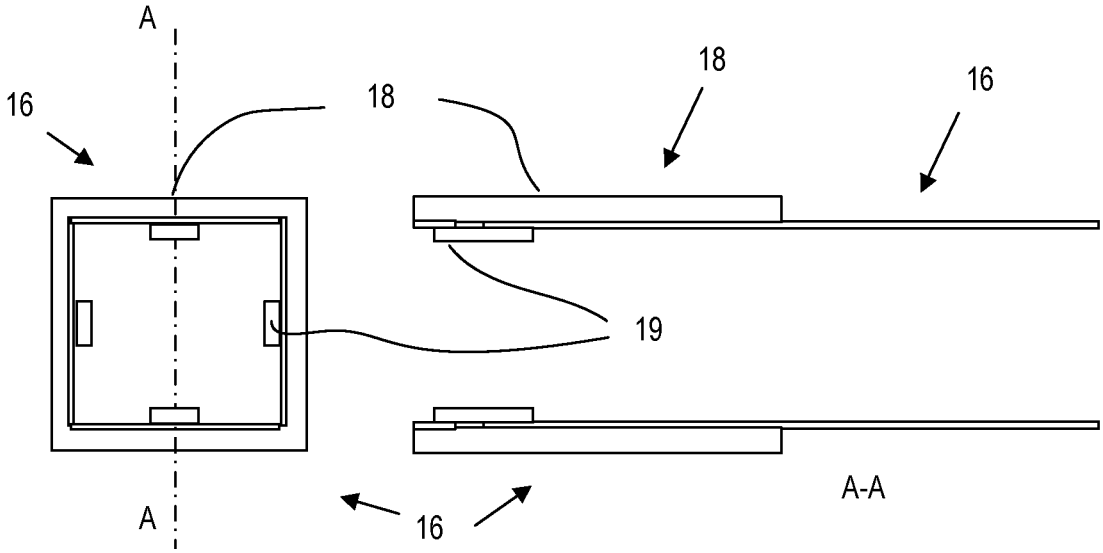
FIG. 10
FIG. 11

FOLDED ANTENNA

TECHNICAL FIELD

The present invention is directed to an antenna that may be produced from a substrate structure or a printed circuit board into a folded structure.

BACKGROUND

In the existing technology, the feed signal is provided typically by a SubMiniature version A, SMA, connector, which is parallel to the feed transmission line. Such feed network would either hinder or seriously limit the integration of the antenna in the receiver/transmitter system as well as add cost. The present solutions are costly and time consuming to produce.

CN105576353 shows what appears to be a bended cylinder-shaped PCB with meander shaped antenna elements.

WO 2012/118636 A2 shows a multi-angle flexible antenna for electronic device comprising an antenna. First and second substrates are joined at a bending line as a single substrate for the flexible antenna and the first substrate allowed to be bent relative to the plane of the second substrate for spatial deployment.

EP3240105 A1 shows an antenna device comprising a metal inverted-F antenna to be mounted onto a printed circuit board. The metal inverted-F antenna acts both as a radiating element and as an interconnecting element.

SUMMARY

It is a first object to set forth an improved antenna unit.

This object has been achieved by an antenna unit comprising a flexible or bendable printed circuit board, PCB, being divided into a number of sections, each section being delimitated from another section by a straight folding line, wherein at least one section accommodates an antenna element, at least another adjacent section either accommodating an antenna element having a terminal area or is a terminal area, the antenna element coupling to the terminal area for feeding the antenna element, the adjacent sections of the PCB being folded along the corresponding delimitating folding line and being kept in or keeping a fixed position, such that the adjacent sections are arranged at respective angles while each section is maintaining a substantially plane configuration.

This object has been achieved by a method for manufacturing an antenna, comprising the steps of devising a flexible or bendable plane printed circuit board, PCB, having a first plurality of sections wherein, at least one section accommodates an antenna element, at least another adjacent section either is accommodating an antenna element having a terminal area or is a terminal area, folding the PCB along the folding line;

arranging the sections such that adjacent antenna elements are keeping or being kept in at a respective angle with respect to one another, while each section is maintaining a substantially plane configuration.

According to an aspect of the invention, an antenna is manufactured from flexible printed circuit board and is folded to the shape needed.

The complete assembly can be surface mounted utilizing standard processes.

Embodiments of the invention allows for flexible contacting of e.g. surface mounted tapered or notch structured antennas by employing a flexible PCB substrate. In this way, for example, a four-element dual polarized antenna forms one surface mounted antenna element, SMAE. This element is feed from beneath the SMAE, which is possible, thanks to the flexible PCB. This embodiment is cost effective and provides high fabrication accuracy and reproducibility.

BRIEF DESCRIPTION OF THE DRAWINGS

FIG. 9 shows a plane substrate of an antenna structure according to another embodiment of the invention and relating to a manufacturing step, FIG. 10 shows a top view of an antenna manufactured from the substrate of FIG. 9 the antenna moreover comprising a support structure, FIG. 11 shows a side view of the antenna element of FIG. 9.

DETAILED DESCRIPTION

Figure 1:
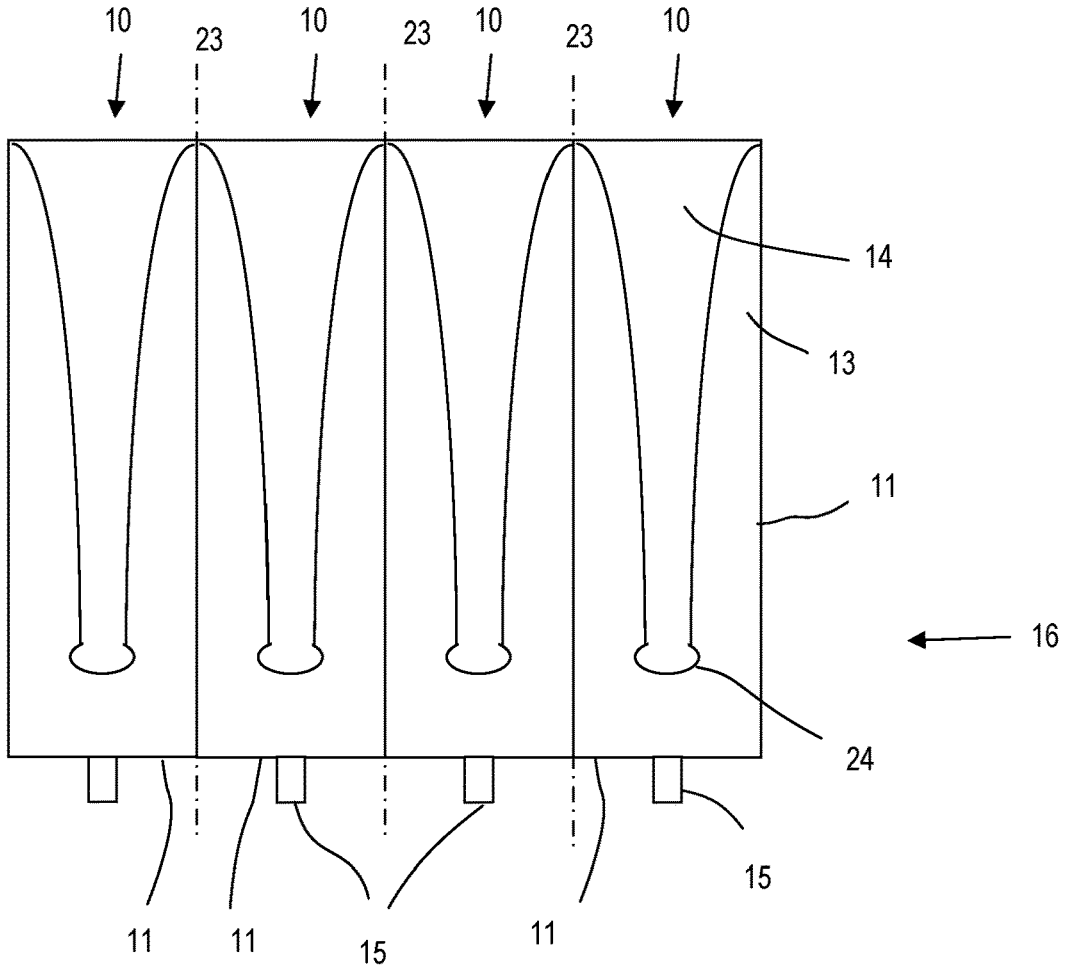
FIG. 1 shows a plane substrate of an antenna structure according to an embodiment of the invention and relating to a manufacturing step.

In FIG. 1, a structure of an antenna unit according to a first embodiment of the invention is shown.

The antenna unit 16 is constructed from a plane structure based on a flexible or bendable substrate such as printed circuit board, PCB, on which a plurality of antenna elements 10 are arranged.

The substrate comprises a number of antenna elements 10, that may have the same shape or configuration. The antenna elements could also be different from another and show individual properties. In the embodiment shown in FIG. 1 the antenna elements are arranged adjacently.

Figure 2:
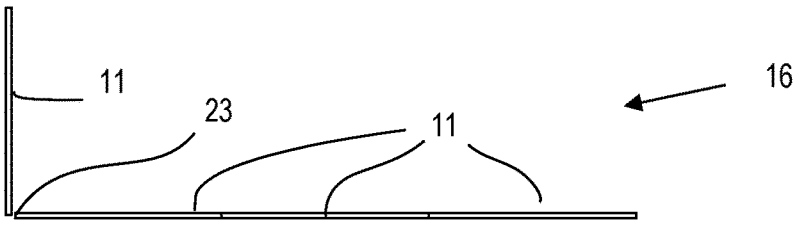
FIG. 2 shows a side view of an antenna manufactured from the substrate of FIG. 1 according to a further step.
Figure 3:
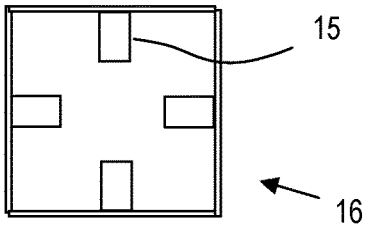
FIG. 3 shows a top view of an antenna manufactured from the substrate of FIG. 1 according to a final step.

The antenna is formed by folding along various folding lines 23, as shown in e.g. FIG. 2. The structure is folded according various manufacturing steps into a given final configuration such as rectangular shape seen from a side view, c.f. FIG. 3. As appears from FIGS. 1 and 3, each antenna element has a corresponding terminal area 15.

Figure 4:
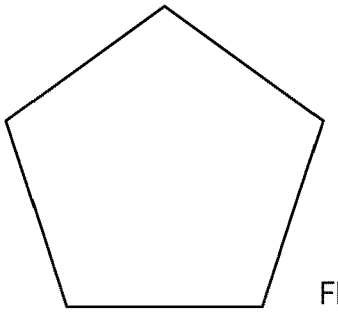
FIG. 4 shows a top view of an antenna manufactured from the substrate of FIG. 1 using an alternative geometric structure (pentagon)
Figure 5:
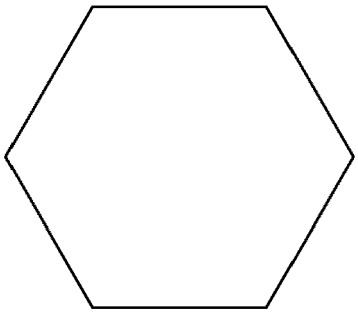
FIG. 5 shows a top view of an antenna manufactured from the substrate of FIG. 1 using an alternative geometric structure (hexagon)

Other side view configurations are also possible such as a pentagon, FIG. 4, hexagon, FIG. 5 or octagon. In these embodiments a plurality of antenna elements 10 are provided and the folding lines 23 delimiting adjacent antenna elements 10 are parallel to one another and the respective angles between adjacent antenna elements are equal.

There is thus provided an antenna unit 16 comprising a flexible or bendable printed circuit board, PCB, 17, being divided into a number of sections 11, each section 11 being delimitated from another section 11 by a straight folding line 23. At least a first plurality of sections 11 each accommodates an antenna element 10, each antenna element having or connecting to an electrical terminal area 15 for feeding the antenna element 10. The sections 11 of the PCB are being folded along the fold lines 23 and being kept in or keeping a fixed position, such that adjacent antenna elements 10 are arranged at respective angles with respect to one another or at a specific distance from one another, while each section 11 is maintaining a substantially plane configuration.

It applies more generally for embodiments of the invention that the antenna unit 16 is comprising a flexible or bendable printed circuit board, PCB 17, being divided into a number of sections 11, each section 11 being delimitated from another section 11 by a straight folding line 23, wherein

- at least one section 11 accommodates an antenna element 10,
- at least another adjacent section 11 either
  - accommodating an antenna element 10 having a terminal area 15 or is
  - a terminal area 15.

The antenna element 10 is coupling to a terminal area 15 for feeding the antenna element 10.

The adjacent sections 11 of the PCB is being folded along the corresponding delimitating folding line 23 and being kept in or keeping a fixed position, such that the adjacent sections 11 are arranged at respective angles while each section 11 is maintaining a substantially plane configuration.

As shown in FIG. 2, the PCB 17 may have a predetermined ductility such that the PCB remains keeping a fixed form after being folded along the respective fold lines 23. In this way the PCB 17 of the antenna unit 16 can remain in its shape during productions steps and a final form could also be accomplished without further retaining means.

The Antenna unit accordingly may have a PCB 17 that is formed by only a metalized layer 13 and a dielectric layer 14. In this form the antenna appears in a micro-strip like configuration. The at least one metalized layer 13 may have a tapered shape.

The PCB 17 comprising may comprise moreover a second metalized layer 25 wherein the metalized layers 13, 25 optionally are being connected by a plurality of vias 26 whereby the antenna is constructed in a strip-line like configuration.

The PCB of the antenna unit may further comprise a second dielectric layer 22 and a conducting layer 21 situated between the first and second dielectric layers 14, 22 and connecting to the terminal area 15 and hence is appearing in a strip-line configuration.

Figure 6:
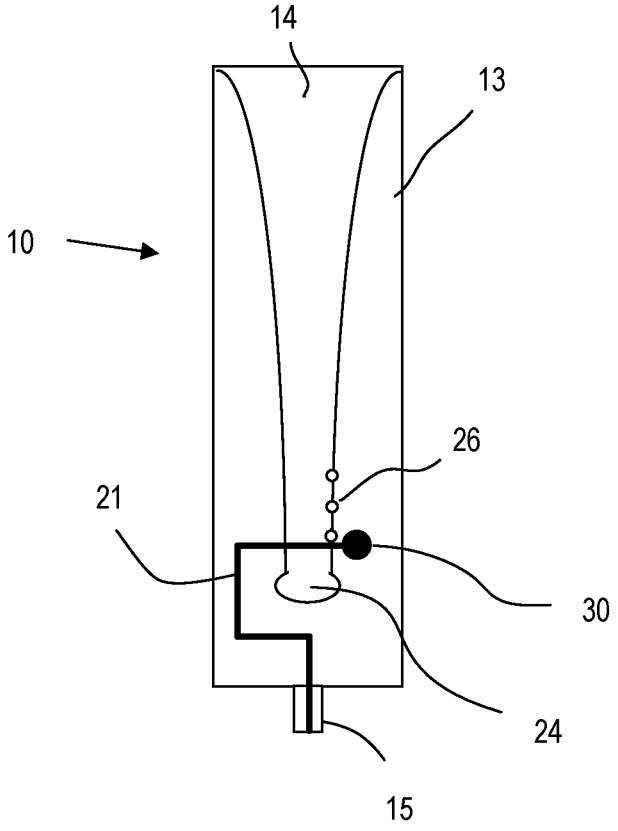
FIG. 6 shows details of an antenna element of the antenna shown in FIG. 1.
Figure 7:
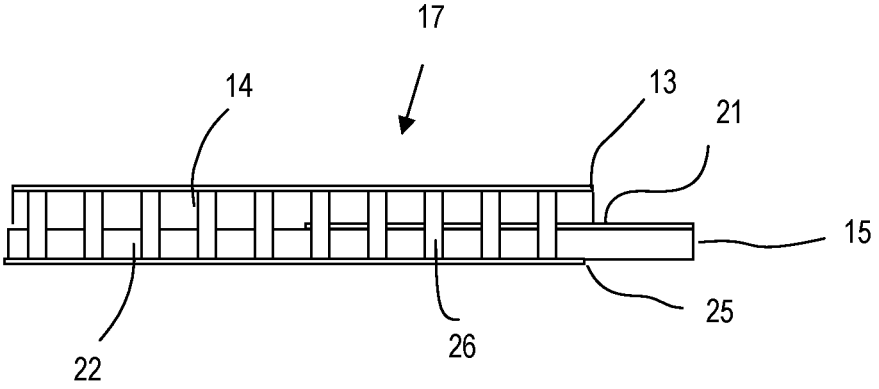
FIG. 7 is a sideview of FIG. 6, FIG. 8A-FIG. 8D show manufacturing steps of the FIG. 1 antenna.

In FIG. 6 an embodiment of an antenna element 10 of the antenna unit 16 shown in FIG. 1 is shown. FIG. 7 is a sideview of FIG. 6. The antenna element is constructed in a strip line configuration comprising from top to bottom: metalized layer 13, dielectric layer 14, metalized layer 21 forming a centre conductor, dielectric layer 15, metalized layer 25.

As appears in FIG. 6, the terminal area 15 is connected via conductor 21 of the conducting layer 21 of the PCB 17 to a stub 30, a section of the conductor is coupling to a waveguide transition area 24. The stub point 30 may attain the shape of a circle or an arc (not shown) as is known in the art. The PCB 17 may carry further surface mounted devices (not shown).

Figure 8A:
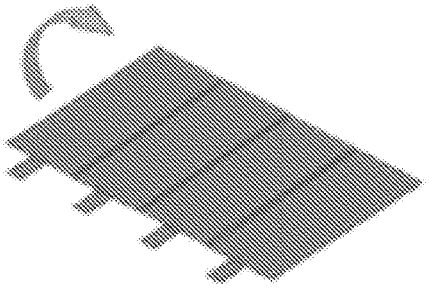
Figure 8B:
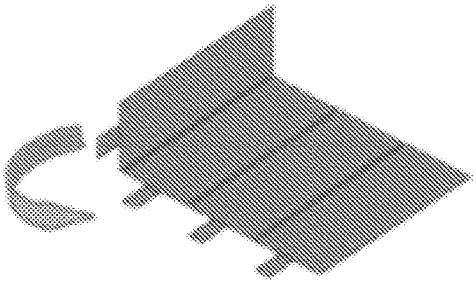
Figure 8C:
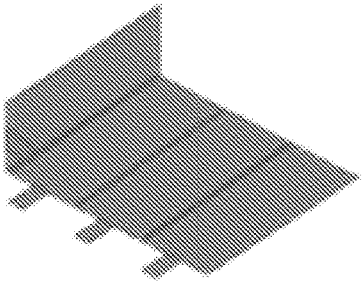
Figure 8D:
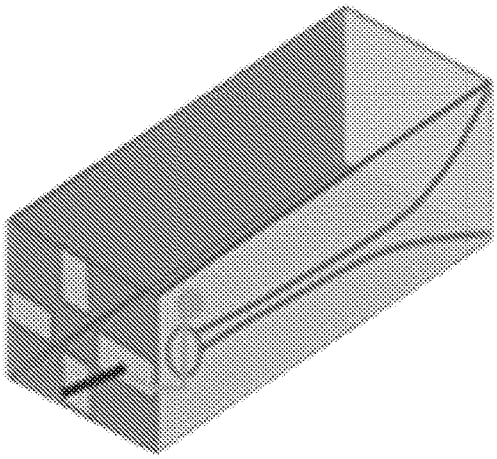

In FIG. 8A-8B manufacturing steps of the FIG. 1 antenna are indicated. First a section 10 forming an antenna element 10 of the PCB 17 is folded, c.f. fig. SB, over folding line 23. It is noted that due to the folding, a bended portion with slightly rounded edges will appear. Subsequently, FIG. 8C, the terminal area 15 of the first antenna element is folded. Various folding steps are carried out such that the antenna unit 16 finally is shaped into a quadratic ground shape. In this embodiment further connection to electrical circuits (not shown) are provided by soldering pins to the terminal areas 15. According to one aspect, antenna elements are connected to driving circuits or a feed network by a folded solder tab using solder or conductive epoxy.

The terminal area 15 may be arranged in the same plane as the antenna element 10, of the PCB 17, to which it connects or the terminal area 15 is formed on a further section 11 that is delimitated by and bended in relation to an adjacent section 11 accommodating an antenna element 10.

In FIG. 9, a further embodiment of forming the terminal areas in a plane relationship with corresponding antenna elements 10 is shown.

In FIGS. 10 and 11 a retaining member 18 is shown. The retaining member 18 fits around the perimeter of the folded antenna and allows the folded antenna to be slid into the retaining member. Inside the retaining member a set of contacting pads 19 are provided that attaches, optionally by press fitting, to the conductor of the conductor layer 21 of the PCB 17 of the antenna element 10. The PCB 17 is thus being kept in a fixed form after being folded over the folding lines 23 by means of a retaining member 18. The retaining member 18 may be surrounding the antenna elements but could also just contact individual contact points corresponding to the contacting pads. As is shown from FIGS. 9-11, at least a terminal area 15 and the corresponding antenna element 10 is in the same plane, when mounted.

In the embodiments above a four antenna elements antenna unit 16 is shown that would be suitable as forming a four-element dual polarized antenna unit. Other configurations are possible and inf~a further embodiment consisting of only two antenna elements is shown. In the latter embodiment the antenna elements are not directly attached adjacently but via void sections 11. A variant of the FIG. 12 embodiment is a two-antenna element configuration based on only three sections whereby one section is void. The void section may be arranged between the antenna elements or the antenna elements may be situated at adjacent sections. A still further variant is an antenna unit consisting of only two sections, each having an antenna element. A still further configuration of an antenna unit is having two sections whereby one section has an antenna element and an adjacent section is void. For the above embodiments, the required structural stability is achieved by fixing at least two respective sections to, e.g., the retaining member 18.

Figure 13:
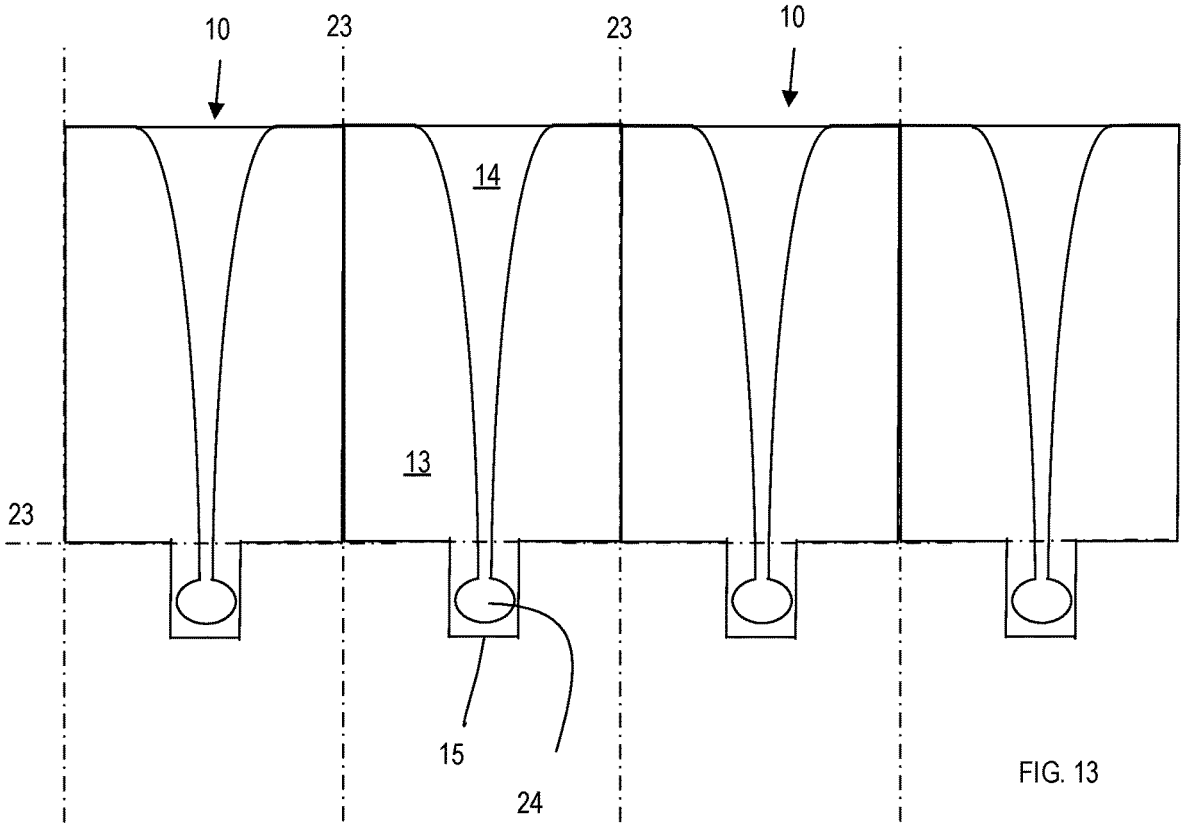
FIG. 13 shows a still further embodiment of an antenna unit comprising multiple antenna elements.
Figure 14:
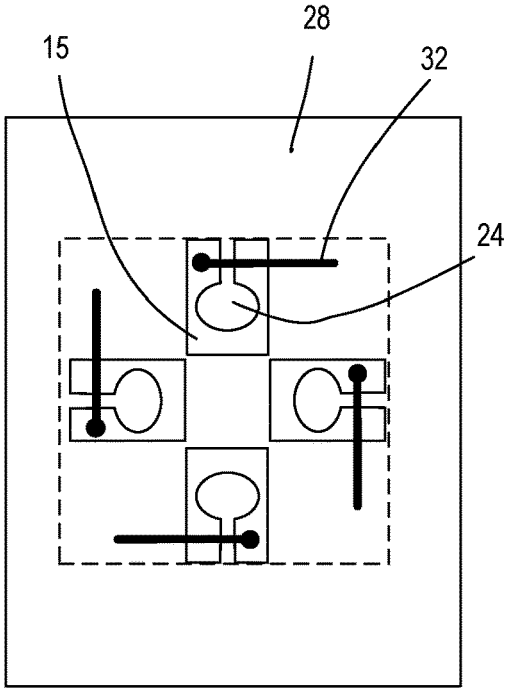
FIG. 14 shows a feed network and electrical terminal areas of the FIG. 13 antenna elements mounted to a feed network.
Figure 15:
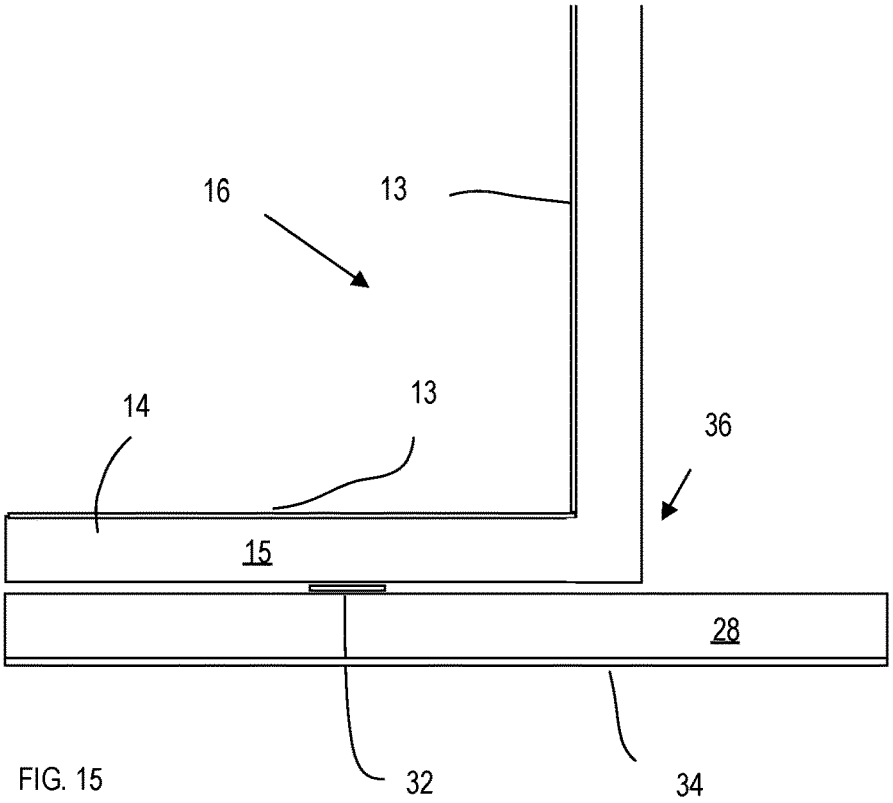
FIG. 15 shows a sideview of an antenna element of the FIG. 13 embodiment mounted on a feed network.

In FIG. 13, a still further embodiment of an antenna unit comprising multiple antenna elements is shown. FIG. 14 shows a feed network and electrical terminal areas of the FIG. 13 antenna elements mounted to a feed network, while FIG. 15 shows a sideview of an antenna element of the FIG. 13 embodiment mounted on a plane feed network 28.

Also for this embodiment, the at least one metalized layer 13 may form a tapered or a notch-like shape. The antenna unit comprises at least two antenna elements 10 being arranged at an angle with respect to one another, each antenna element having terminal area 15 arranged at 90 degrees.

Again, the terminal areas 15 are formed on further sections 11 of the PCB 17 and delimitated by folding line 23 from the respective antenna element 10 to which the terminal area 15 couples and being arranged at an angle in relation to the antenna element 10 when mounted. Each terminal area 15 of the respective antenna elements 10 is mounted on the plane feed network 28. The plane feed network could be formed on a second PCB. The feed network 28 comprises a feed conductor 32 being mounted on dielectric layer 28 that may also have a metalized ground layer 34. The feed conductor 32 is coupling to the waveguide transition area 24 of the antenna element 10. Options are devised wherein the feed conductor 32 is coupling to the waveguide transition area 24 of the antenna element 10 through at least one dielectric layer 14 of at least one of the PCB 17 of the antenna element and the feed network 28, 32.

In FIG. 14, the terminal areas 15 are pointing inwards but could also be arranged pointing outwards. Variants where some terminal areas pointing inwards while other point outwards are also possible. It should be noted that e.g. FIG. 15 is to be understood schematically as in particular the edge where the PCB 17 is folded may appear having a more smoothly bended edge 36 than shown.

In the FIGS. 13 - 14 embodiment, a four-element antenna unit is provided. The antenna elements are arranged at an angle between one another and such that the at least two antenna elements each have a terminal area 15 arranged at 90 degrees with respect to the corresponding antenna element 10. Thereby, the antennas are retained in fixed position to one another and the feed network 28 when the terminal areas are mounted to the feed network. In a 15 two-antenna element design, the terminal areas may be folded to the same side or to differing sides of the PCB 17.

The feed conductor 32 is coupling to the waveguide transition area 24 of the antenna element 10 through at least one dielectric layer 14 of at least one of the PCB 17 of the antenna element and the feed network 28, 38.

Figure 12:
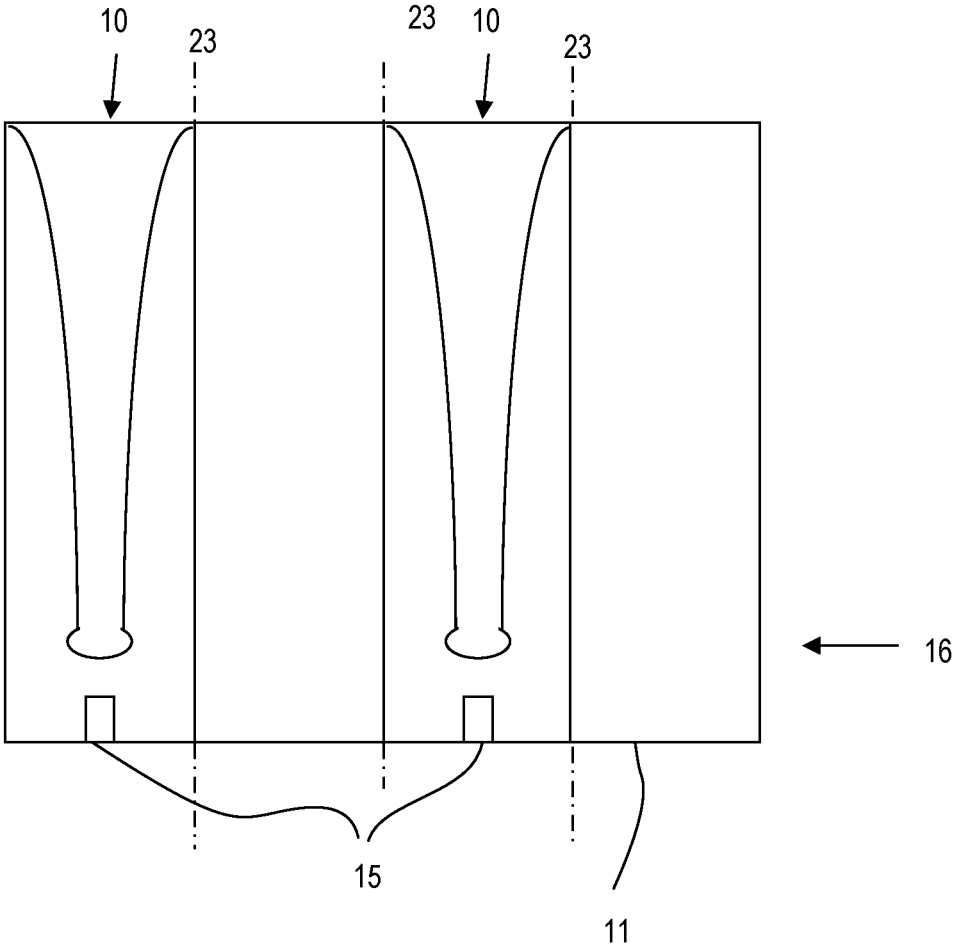
FIG. 12 shows a further embodiment of an antenna.

In line with the embodiment above described with respect to FIG. 12, a number of variants are foreseen of one, two and three antenna element configurations. An advantageous embodiment for a one antenna element antenna unit comprises two adjacent sections, whereby one has an 25 antenna element and the other is void. Both adjacent sections may again each have a respective further adjacent section for attaching to a plane feed network, such that in total four sections are provided. Hence, the antenna unit 16 could for instance consist of only of two antenna elements 10, whose sections are being arranged in different planes when mounted.

It should be understood that for a void section, a "dummy" terminal area not coupling to an antenna element may be provided for the purpose of providing a point for soldering and thereby providing a mechanical attachment point. For such an embodiment, a single antenna element antenna unit could be configured.

Figure 16:
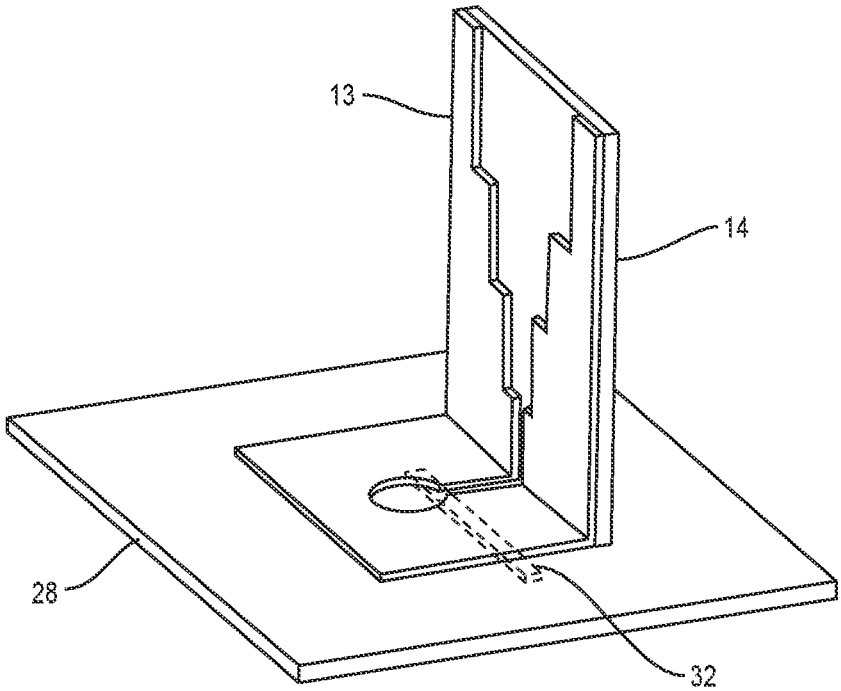
FIG. 16 is an isometric view of a still further embodiment.
Figure 17:
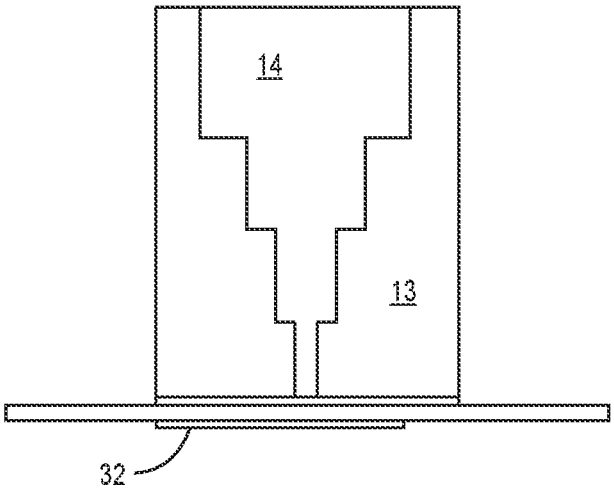
FIGS. 17 and 18 are side-views of FIG. 16.
Figure 18:
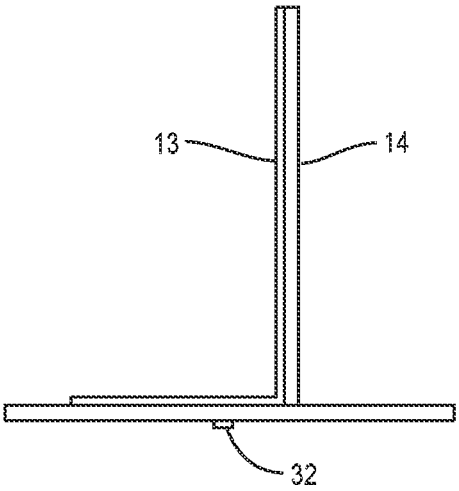

FIG. 16 is an isometric view of a still further embodiment, and FIGS. 17 and 18 are side-views of FIG. 16. This embodiment forms a micro-strip like configuration that consists of very few elements. The metalized layer is notched shaped. The feed conductor 32 is arranged on the opposing side of the side at which the terminal area of the antenna units is attached. A shown in FIG. 16, the dielectric layer may be substantially removed on a section corresponding to the terminal area 15, but variants are also possible where the PCB 17 is simply folded and mounted as shown in FIG. 15.

Figure 19:
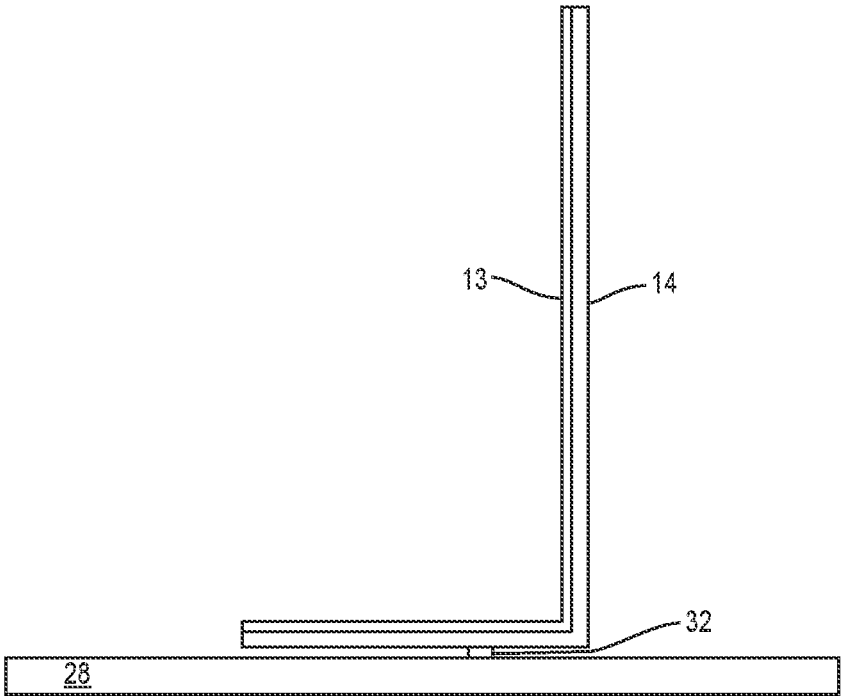
FIG. 19 is a variant of the FIG. 16 embodiment.

FIG. 19 shows a variant of the FIG. 16 embodiment, where feed conductor 32 is arranged between the PCB 17 and a dielectric layer of feed network 28.

Figure 20:
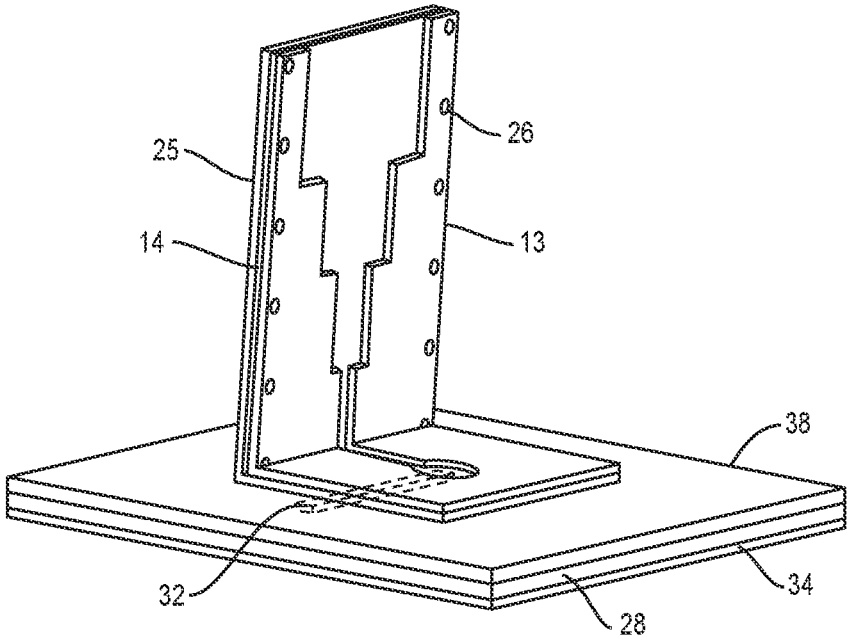
FIG. 20 is an isometric view of a still further embodiment.
Figure 21:
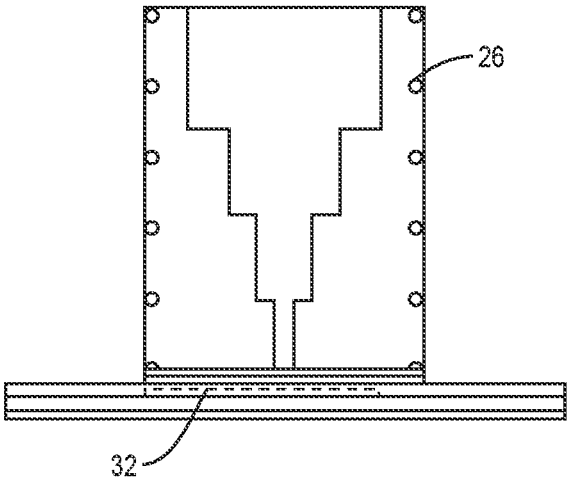
FIGS. 21 and 22 are side-views of FIG. 20.
Figure 22:
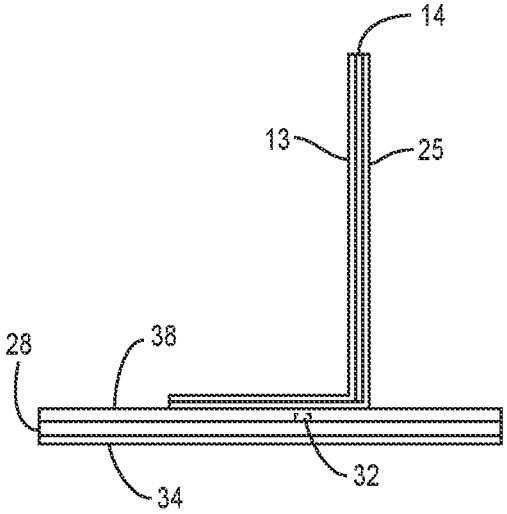

FIG. 20 is an isometric view of a still further embodiment. FIGS. 21 and 22 are side-views of FIG. 20. This embodiment is a strip-line configuration in which the metalized layer 25 is removed on a portion corresponding to the terminal area 15, such that dielectric layer 14 is mounted directly on a further dielectric layer 38 of the feed network 28. A metalized ground layer is arranged on the feed network on the side opposite to the side where the antenna element 10 is mounted.

The embodiments shown in FIGS. 17-22 could when adapted for operating in e.g. the 38 GHz range for which the dimensions of e.g. the width of the terminal area 15 is in the range of 2.5-5 mm.

The above embodiments may be manufactured by:

- devising a flexible or bendable plane printed circuit board, PCB, 17 having a first plurality of sections 11 wherein,
- at least one section 11 accommodates an antenna element 10,
- at least another adjacent section 11 either is
- accommodating an antenna element 10 having a terminal area 15 or is
- a terminal area 15
- folding the PCB 17 along the folding line 23;
- arranging the sections 11 such that adjacent antenna elements 10 are keeping or being kept in at a respective angle with respect to one another, while each section 11 maintains a substantially plane configuration.

Optionally, the step of being kept in at a respective angle comprises

- attaching the folded PCB 17 to a retaining member 18.

For the configuration where the antenna unit further comprises a plane feed network 28 comprising a feed conductor 32 and the antenna unit 16 comprises at least two antenna elements 11, the step of being kept in at a respective angle may comprise

- arranging the terminal areas 15 at a 90-degree angle with respect to a corresponding antenna element 10,
- arranging the at least two antenna elements, at an angle to one another,
- mounting the terminal areas 15 to the plane feed network 28.

The mounting may be carried out by gluing. The mounting of the antenna elements, or rather the terminal areas 15, to the plane feed network 28 can also be done by Surface Mount Technology, SMT, in the same manner as mounting Surface Mounted Devices, SMD.

Hence, the complete assembly can be surface mounted utilizing standard processes.

To sum up, embodiments of the invention allows flexible contacting of e.g. surface mounted tapered or notch structured antennas by employing flexible PCB substrate. In this way, for example, a four-element dual polarized antenna forms one surface mounted antenna element SMAE. This element is feed from beneath the SMAE, which is possible, thanks to the flexible PCB. This solution is cost effective and provides high fabrication accuracy and reproducibility

REF SIGNS

10 antenna element
11 section of PCB
13 metalized layer
14 dielectric/PCB substrate layer
15 electrical terminal area
16 antenna unit
17 PCB
18 retaining member
19 contacting pads
21 conductor layer centre
22 dielectric/PCB substrate layer
23 folding line
24 wave guide transition area
25 metalized layer
26 via hole
28 feed network
30 stub
32 feed conductors
34 ground layer
36 bend
38 dielectric layer

The invention claimed is:

1. An antenna unit, comprising:

a flexible or bendable printed circuit board (PCB) being divided into a number of sections, each section being delimitated from another section by a straight folding line extending the full length of the PCB from a first edge to an opposite, second edge;

wherein at least one section accommodates an antenna element;

wherein at least another adjacent section either: accommodates an antenna element having a terminal area; or is a terminal area;

wherein each terminal area comprises a dielectric layer, and optionally a conductive layer, of the PCB; wherein the antenna element couples to the terminal area for feeding the antenna element;

wherein the adjacent sections of the PCB are folded the full length of the PCB along the corresponding delimitating folding line and being kept in or keeping a fixed position, such that the adjacent sections are arranged at respective angles, while each section maintains a substantially planar configuration; and wherein each terminal area is folded to be substantially perpendicular to a plane of a connected section of the PCB.

2. The antenna unit of claim 1:

wherein a plurality of antenna elements are provided;

wherein the fold lines delimiting adjacent antenna elements are parallel to one another and the respective angles between adjacent antenna elements are equal.

3. The antenna unit of claim 1, wherein the PCB has a predetermined ductility such that the PCB remains in a fixed form after being folded along the respective fold lines.

4. The antenna unit of claim 1, wherein the PCB is kept in a fixed form after being folded over the folding lines by means of a retaining member.

5. The antenna unit of claim 1, wherein the PBC is formed by a first metalized layer and a first dielectric layer.

6. The antenna unit of claim 5:

wherein the PCB further comprises a second metalized layer;

wherein the first and second metalized layers are connected by a plurality of vias.

7. The antenna unit of claim 6, wherein the PCB further comprises a second dielectric layer and a conducting layer situated between the first and second dielectric layers, the conducting layer connecting to the terminal area.

8. The antenna unit of claim 5, wherein the first metalized layer forms a tapered or notch shape.

9. The antenna unit of claim 7, the terminal area connects to a stub via a conductor of the conducting layer of the PCB, a section of the conductor coupling to a waveguide transition area.

10. The antenna of claim 4, wherein the terminal area attaches to contacting pads provided on the retaining member.

11. The antenna unit of claim 1, wherein the antenna unit comprises at least two antenna elements, whose corresponding sections are arranged in different planes when mounted.

12. The antenna unit of claim 11, wherein the terminal area is mounted on a plane feed network, the feed network comprising a feed conductor.

13. The antenna unit of claim 12, wherein the antenna element is mounted to the feed network by Surface-Mount Technology (SMT).

14. The antenna unit of claim 12:

wherein the antenna unit comprises at least two antenna elements arranged at an angle between one another;

wherein the at least two antenna elements each have a terminal area arranged at 90 degrees relative to the corresponding antenna element, thereby retaining the antennas in fixed position to one another and the feed network.

15. The antenna unit of claim 12, wherein the feed conductor couples to a waveguide transition area of the antenna element through at least one dielectric layer of the PCB of the antenna element and the feed network.

16. The antenna unit of claim 1, wherein the antenna unit forms a part of a four-element dual polarized antenna unit.

17. A method for manufacturing an antenna, the method comprising:

devising a flexible or bendable plane printed circuit board (PCB) having a first plurality of sections, each section being delimitated from another section by a straight folding line extending the full length of the PCB from a first edge to an opposite, second edge; wherein:

at least one section accommodates an antenna element; and at least another adjacent section either accommodates an antenna element having a terminal area or is a terminal area;

wherein each terminal area comprises a dielectric layer, and optionally a conductive layer, of the PCB;

folding the PCB the full length of the PCB along the folding line;

arranging the sections such that adjacent antenna elements are, or are kept, in at a respective angle with respect to one another, while each section maintains a substantially planar configuration; and folding each terminal area such that it is substantially perpendicular to a plane of a connected section of the PCB.

18. The method of claim 17, further comprising attaching the folded PCB to a retaining member to keep the adjacent antenna sections in the respective angle with respect to one another.

19. The method of claim 17:

wherein the antenna unit further comprises a plane feed network, the feed network comprising a feed conductor;

wherein the antenna unit comprises at least two antenna elements;

wherein the method comprises:

arranging the terminal areas at a 90 degree angle relative to a corresponding antenna element;

arranging the at least two antenna elements at an angle to one another;

mounting the terminal areas to the plane feed network.

20. The method of claim 19, wherein the mounting of the terminal areas to the plane feed network comprises mounting of the terminal areas to the plane feed network by Surface-Mount Technology (SMT).

* * * * *